US008701454B2

(12) United States Patent
Cripsey et al.

(10) Patent No.: US 8,701,454 B2
(45) Date of Patent: Apr. 22, 2014

(54) FLOW FORM TOOL MANDREL

(75) Inventors: Timothy J. Cripsey, Rochester, MI (US); Anthony Ziebron, Washington, MI (US); Joshua Gottschling, Sterling Heights, MI (US); Robert J. Herston, New Baltimore, MI (US)

(73) Assignee: Metal Forming & Coining Corporation, Maumee, OH (US)

( * ) Notice: Subject to any disclaimer, the term of this patent is extended or adjusted under 35 U.S.C. 154(b) by 610 days.

(21) Appl. No.: 13/017,561

(22) Filed: Jan. 31, 2011

(65) Prior Publication Data

US 2011/0185782 A1 Aug. 4, 2011

Related U.S. Application Data

(60) Provisional application No. 61/299,374, filed on Jan. 29, 2010.

(51) Int. Cl.
*B21D 22/16* (2006.01)

(52) U.S. Cl.
USPC ..... 72/84; 72/82; 72/97; 72/107

(58) Field of Classification Search
USPC ..... 72/82–85, 97, 102, 105, 107–109, 72/370.05, 370.08, 393, 466, 481.1; 29/893.3, 893.32; 242/571, 571.1, 242/571.2

See application file for complete search history.

(56) References Cited

U.S. PATENT DOCUMENTS

| | | | | |
|---|---|---|---|---|
| 3,640,115 | A * | 2/1972 | Duncan et al. | 72/393 |
| 5,584,202 | A | 12/1996 | Kanamaru et al. | |
| 5,934,126 | A | 8/1999 | Maruki et al. | |
| 6,530,253 | B1 | 3/2003 | Gotou et al. | |
| 6,694,791 | B1 | 2/2004 | Johnston et al. | |
| 2009/0217725 | A1 | 9/2009 | Cripsey et al. | |

* cited by examiner

*Primary Examiner* — Debra Sullivan
(74) *Attorney, Agent, or Firm* — Fraser Clemens Martin & Miller LLC; J. Douglas Miller

(57) ABSTRACT

An apparatus includes a mandrel having a first end and a second end, the mandrel including a cavity formed therein, a pilot disposed in the cavity formed in the mandrel, a portion of the pilot extending outwardly from the first end of the mandrel, and an insert disposed in a channel formed in the mandrel and through an exterior surface of the mandrel, wherein a portion of the pilot abuts the insert and radial outward movement of the insert is caused by an axial movement of the pilot.

20 Claims, 9 Drawing Sheets

FLOW FORM TOOL MANDREL

CROSS REFERENCE TO RELATED APPLICATIONS

This application is entitled to the benefit of, and claims priority to, U.S. provisional patent application Ser. No. 61/299,374 filed Jan. 29, 2010, the entire disclosure of which is incorporated herein by reference.

FIELD OF THE INVENTION

The present invention relates to a flow form tool mandrel. In particular, the invention is directed to a flow form tool mandrel to facilitate the forming of oil holes through the use of a moving tool detail.

BACKGROUND OF THE INVENTION

Flow forming is a process used to produce a formed metal part. Flow forming is the use of metal forming lathes to extrude a blank or a preform prepared from a desired material into the formed metal part. Flow forming provides the features traditionally provided by a stamping process while providing the additional benefits of improved dimensional capabilities, work hardening up to three-times the initial material properties, and the ability to use the part after formation with limited or no additional machining required.

Typical flow formed parts include gears, clutch drums, and other similar parts that may include oil holes. The conventional means for forming parts having oil holes typically results in undesirable burrs and other surface flaws on the formed part. Therefore, the cost of production and the overall efficiency of the process utilizing the part are adversely affected.

It would be desirable to produce a flowform tool to facilitate a forming of features such as oil holes in a part through the use of a moving tool detail.

SUMMARY OF THE INVENTION

Concordant and consistent with the present invention, a flowform tool to facilitate a forming of features such as oil holes in a part through the use of a moving tool detail, has surprisingly been discovered.

In one embodiment, an apparatus comprises: a mandrel having a first end and a second end, the mandrel including a cavity formed therein; a pilot disposed in the cavity formed in the mandrel, a portion of the pilot extending outwardly from the first end of the mandrel; and an insert disposed in a channel formed in the mandrel and through an exterior surface of the mandrel, wherein a portion of the pilot abuts the insert and radial outward movement of the insert is caused by an axial movement of the pilot.

In another embodiment, an apparatus comprises: a mandrel having a first end and a second end, the mandrel having a cavity formed therein; a pilot disposed in the cavity formed in the mandrel, a portion of the pilot extending outwardly from the first end of the mandrel; an ejector couple to a second end of the pilot opposite the first end of the pilot, wherein the ejector controls a movement of the pilot relative to the mandrel; and an insert moveably disposed in a channel formed in the mandrel and through an exterior surface of the mandrel, wherein a portion of the pilot abuts the insert and radially outward movement of the insert is caused by an axial movement of the pilot.

The present invention also includes methods of forming a part.

One method comprises the steps of: providing a blank formed of a flowable material; providing a tool including a mandrel having a first end and a second end, a pilot moveably disposed in a cavity formed in the mandrel, a portion of the pilot extending outwardly from the first end of the mandrel, and an insert moveably disposed in a channel formed through an exterior surface of the mandrel; positioning the blank adjacent the first end of the mandrel; and applying pressure to the blank to cause the material of the blank to flow around the mandrel to form a part, at least a portion of the material flowing over the insert extending generally radially outwardly from the exterior wall of the mandrel.

DRAWINGS

The above, as well as other advantages of the present invention, will become readily apparent to those skilled in the art from the following detailed description of the preferred embodiment when considered in the light of the accompanying drawings in which.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, are not necessary or critical.

Figure 1:
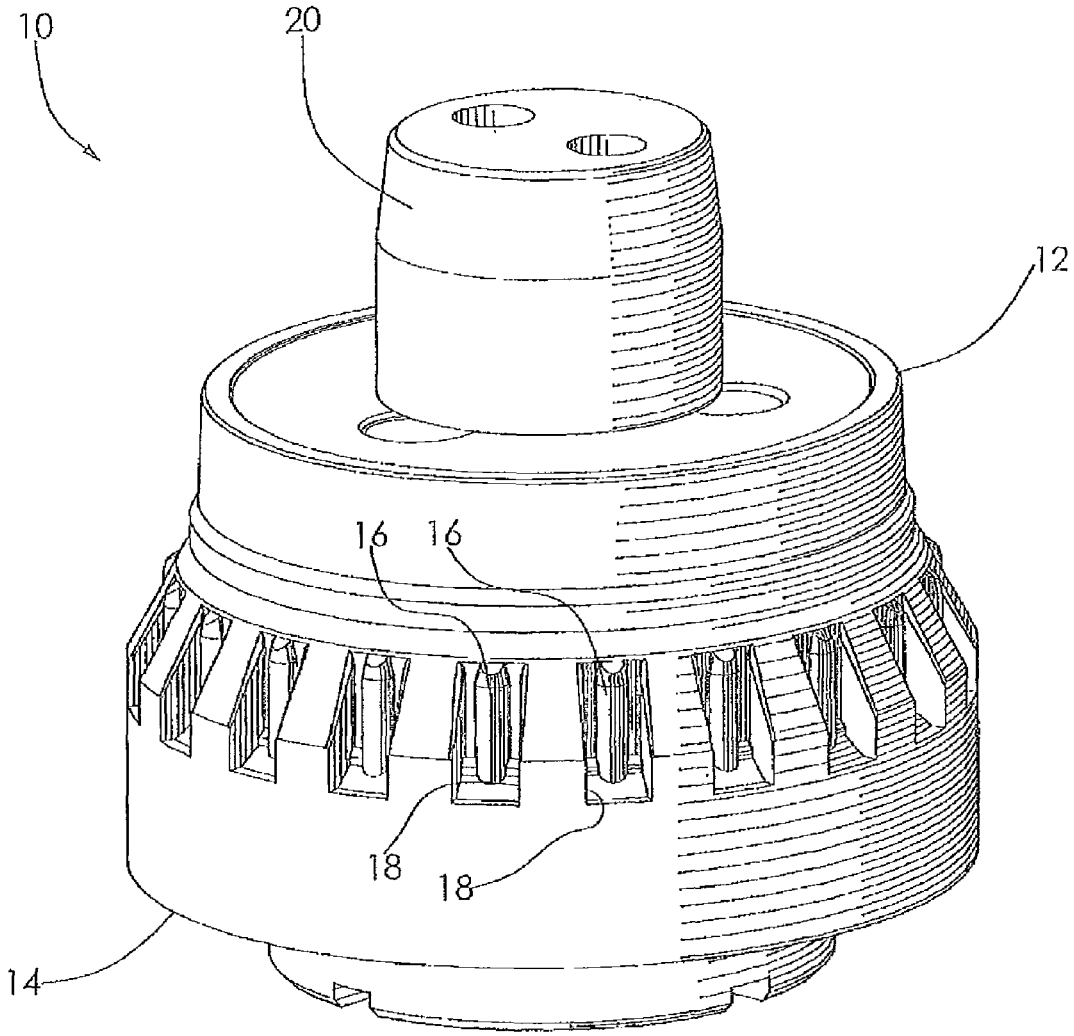
Fig. 1 (Prior Art)
FIG. 1 is a perspective view of a tool used to produce a splined part according to the prior art.
Figure 4:
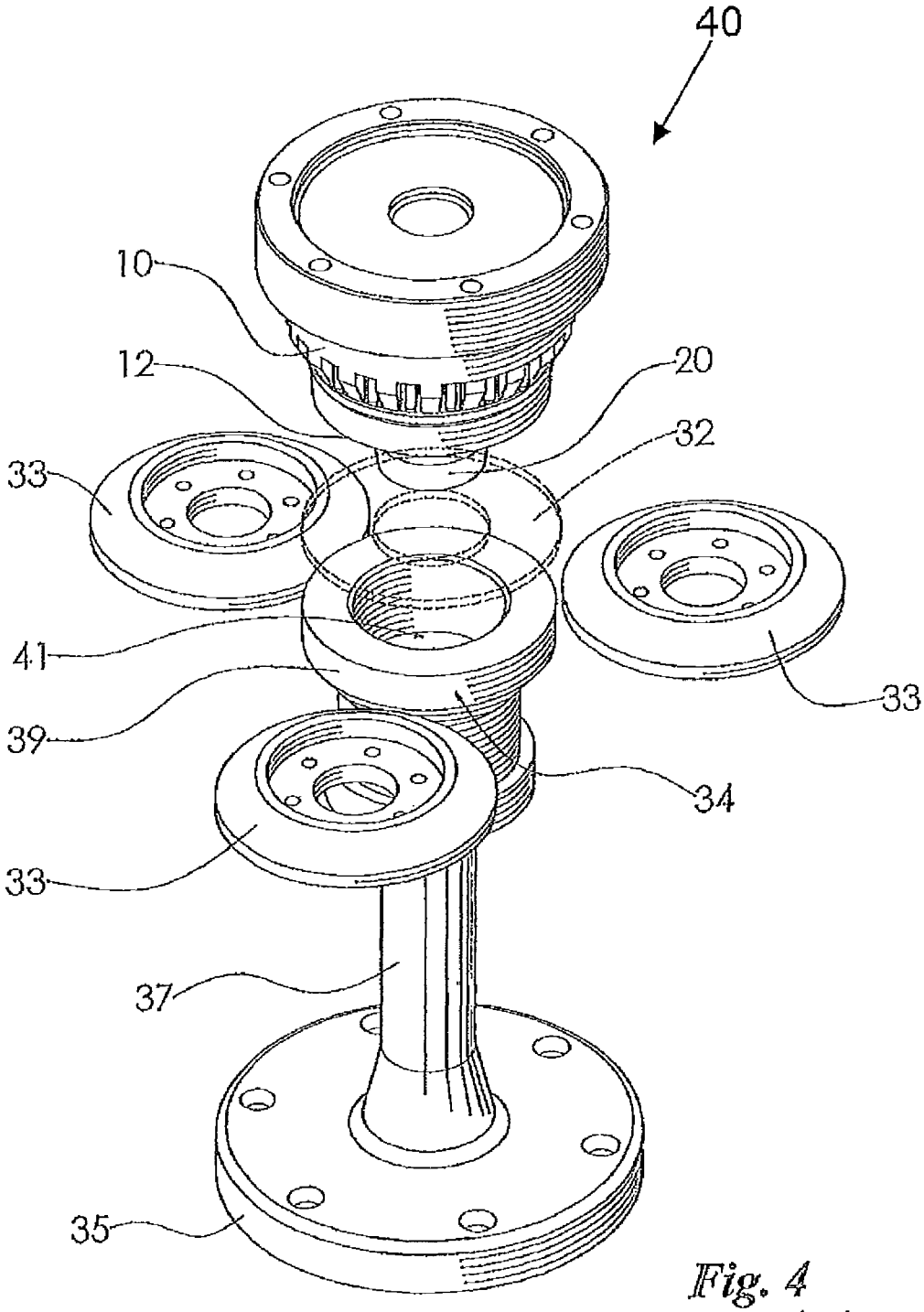
Fig. 4 (Prior Art)
FIG. 4 is a perspective view of a flow forming apparatus including the tool of FIG. 1, a blank, a plurality of rollers, and a pressure plate according to the prior art.

FIG. 1 shows a tool 10 of the prior art. The tool 10 can be any conventional tool such as a tool for producing a clutch drum, for example. The tool 10 includes a first end 12 and a second end 14. The first end 12 of the tool 10 includes a stem 20 extending therefrom adapted to be inserted into an aperture of a blank 32 (shown in FIG. 4) prepared from a desired material. It is understood that the stem 20 may be an integrally formed portion of the tool 10 or separately formed and attached to the tool 10, if desired. Any conventional deformable material can be used to prepare the blank 32 such as steel, a steel alloy, titanium, or aluminum, for example. FIG. 4 shows the blank 32 as an annular ring, however it is understood that the blank 32 may have any shape such as round, for example, as desired. An exterior of the tool 10 has an annular array of spline forming recesses 16 formed therein intermediate the first end 12 and the second end 14. The spline forming recesses 16 have sharp corners 18 or fillets.

Figure 2:
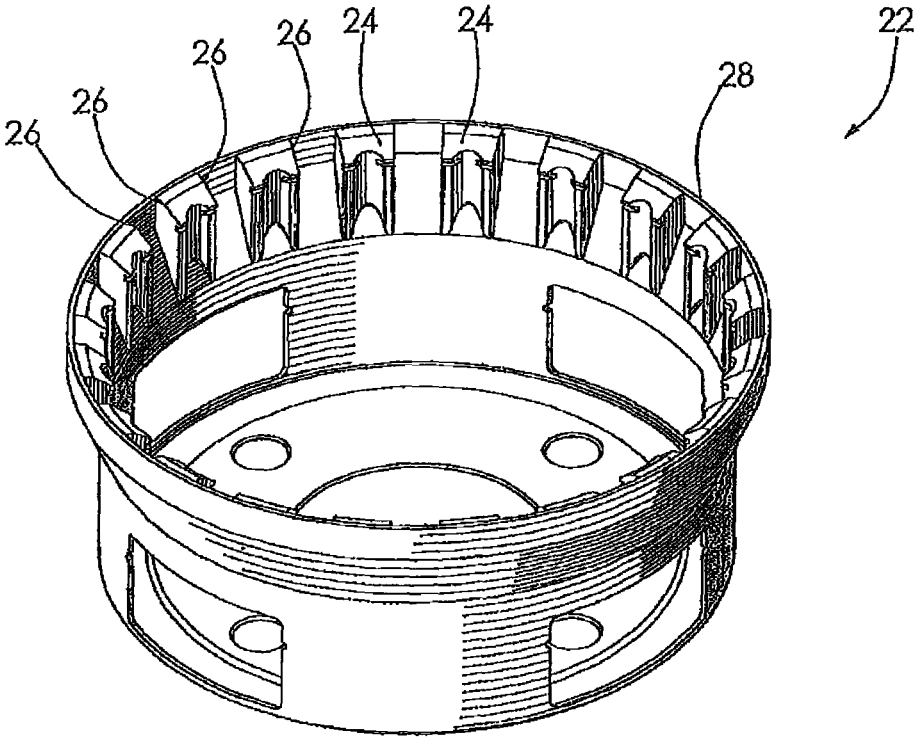
Fig. 2 (Prior Art)
FIG. 2 is a perspective view of a splined part produced using the tool shown in FIG. 1 according to the prior art.
Figure 3:
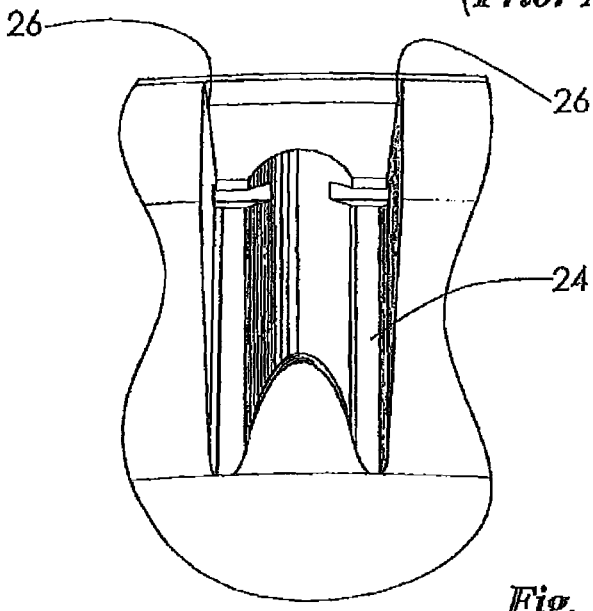
Fig. 3 (Prior Art)
FIG. 3 is an enlarged fragmentary perspective view of a spline of the part illustrated in FIG. 2 according to the prior art.

The flow formed part 22 of the prior art shown in FIG. 2 is formed from the blank 32 using the tool 10. The flow formed part 22 of the prior art includes an annular array of splines 24 having sharp corners 26 or fillets formed at an outer edge 28 of the flow formed part 22. Any conventional deformable material can be used to form the flow formed part 22 such as steel, a steel alloy, titanium, copper, for example. It is understood that the flow formed part 22 may be any part adapted to transfer rotational motion from a first rotating member to a second rotating member, such as a gear, for example.

The process to form the flow formed part 22 is a multi-step process. First, the blank 32 is formed by punching, cutting, or shearing the blank 32 from a sheet stock of material to a predetermined shape. The blank 32 is then disposed in a flow forming apparatus 40. The apparatus 40 includes the tool 10, a plurality of rollers 33, and a pressure plate 34. It is understood that the tool 10 may be a male die, a female die, or a die with both male and female die portions. The pressure plate 34 includes a bearing plate 35, a stem 37 slidably disposed through an aperture (not shown) in the bearing plate 35, an annular shoulder 39 having a cavity 41 adapted to receive at least a portion of the stem 20 of the tool 10, and a hydraulic cylinder (not shown) adapted to apply a force on the stem 37 to cause it to slidably reposition. It is understood that the hydraulic cylinder may be any means of providing a force to slidably position the stem 37 of the pressure plate 34. The blank 32 is disposed on the stem 20 of the tool 10 with the stem 20 positioned through the aperture 30 of the blank 32. The stem 20 of the tool 10 and the pressure plate 34 are slidably positioned such that the stem 20 of the tool 10 is received by the cavity 41 formed in the annular shoulder 39. The tool 10 and pressure plate 34 are then clamped together such that the blank 32 is disposed between the first end 12 of the tool 10 and the annular shoulder 39 of the pressure plate 34. The tool 10, the blank 32, and the stem 37 are then caused to axially rotate relative to the bearing plate 35 while the hydraulic cylinder applies a constant pressure on the stem 37 to maintain a position of the pressure plate 34 and tool 10 during a flow forming operation. Next, the rollers 33 are caused to apply pressure to the blank 32 to deform the blank 32 and cause the blank 32 to flow into the spline forming recesses 16 formed in the tool 10. As the pressure on the blank 32 caused by the rollers 33 increases, the temperature of the blank 32 increases and the blank 32 becomes more malleable to facilitate the flow of the material that forms the blank 32 into the spline forming recesses 16 of the tool 10. Once the material has been caused to fill the spline forming recesses 16, the tool 10 is removed from the flow formed part 22 resulting in a part having an annular array of splines 24 formed thereon, as illustrated in FIG. 2.

Figure 5:
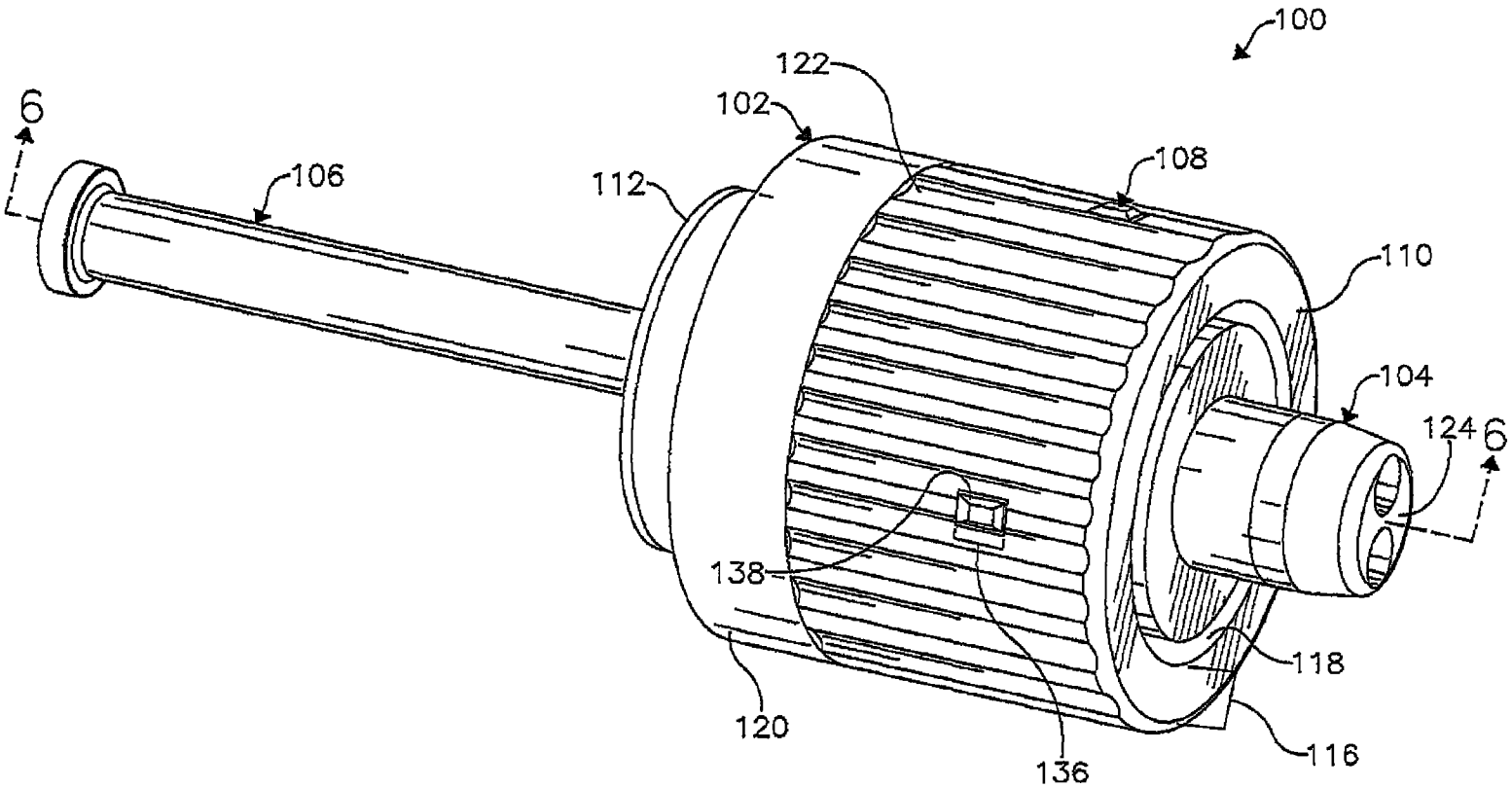
FIG. 5 is a perspective view of a tool according to an embodiment of the invention.
Figure 6:
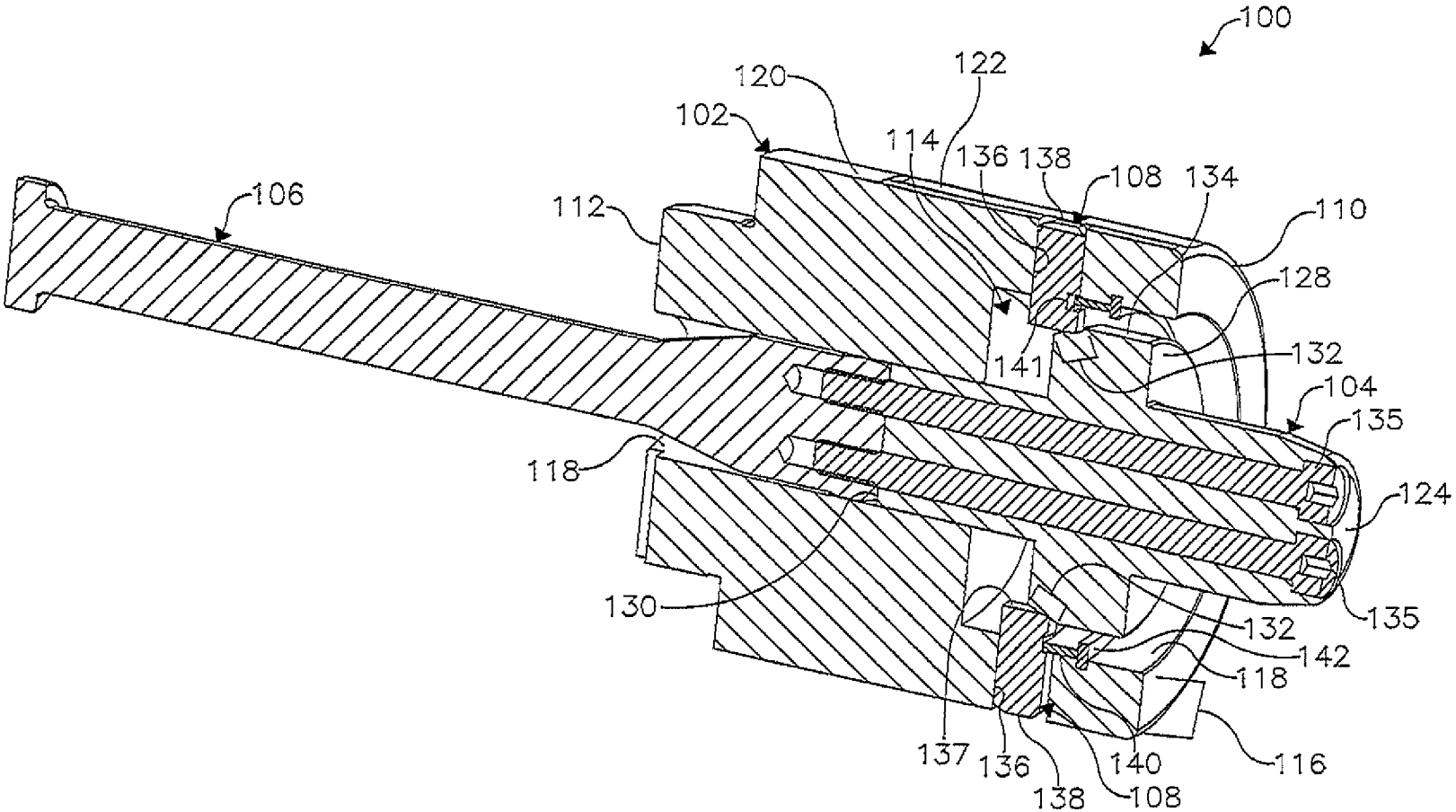
FIG. 6 is a cross-sectional perspective view of the tool of FIG. 5 taken along line 6-6.
Figure 7:
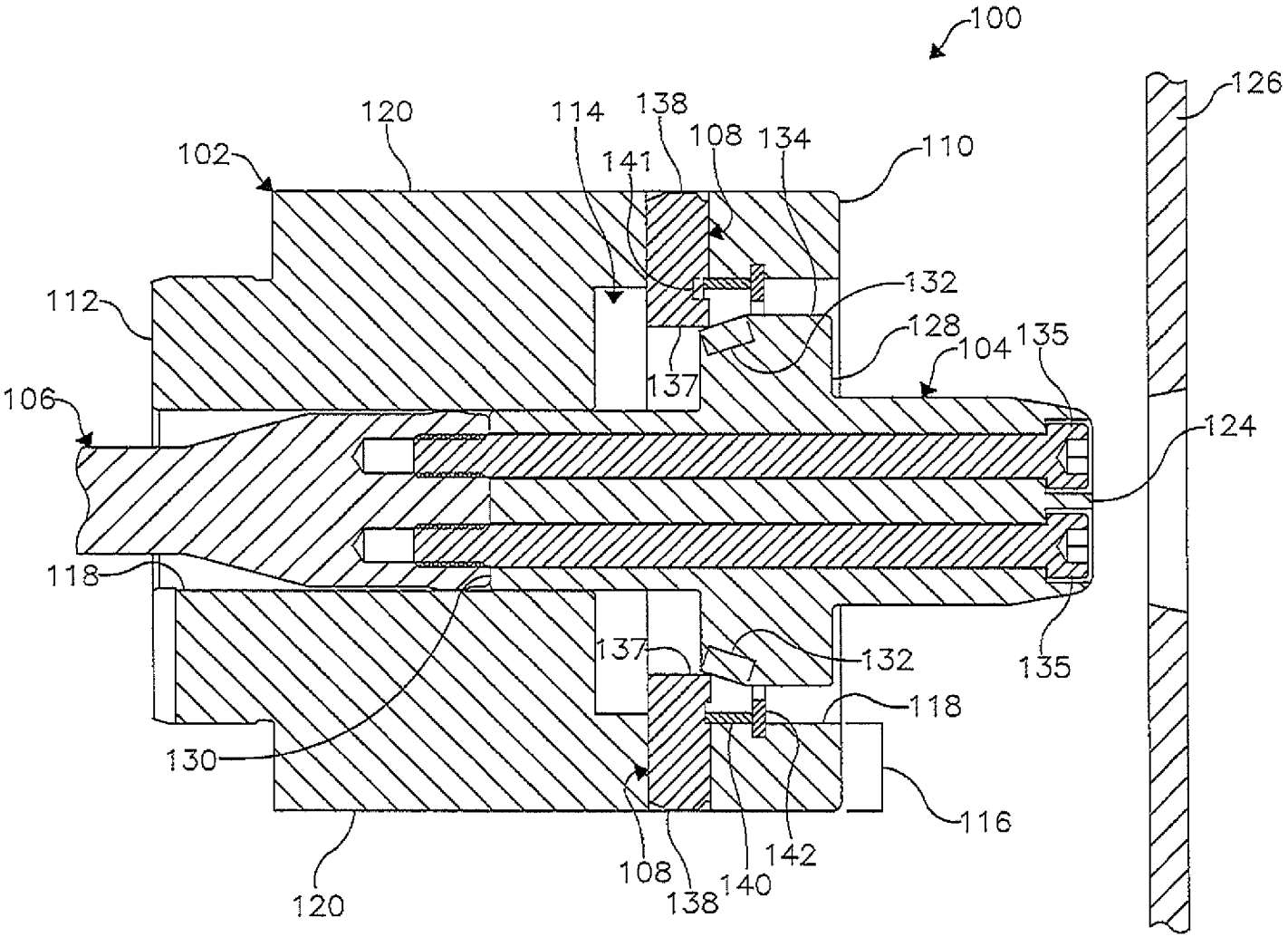
FIG. 7 is a fragmentary cross-sectional side elevational view of the tool of FIG. 5 disposed adjacent a blank, a pilot of the tool shown in an extended position.

FIG. 5 illustrates a tool 100 according to an embodiment of the present invention. The tool 100 can be any conventional tool such as a tool for making a clutch drum, a drive shell, a slip spline, or other part, for example. In the embodiment shown, the tool 100 includes a mandrel 102, a pilot 104, an ejector 106, and a plurality of inserts 108.

The mandrel 102 has a first end 110 and a second end 112. As shown in FIGS. 6-10, a cavity 114 is defined in the mandrel 102 between the first end 110 and the second end 112 and configured to receive the pilot 104 therein. In certain embodiments, the mandrel 102 includes an annular shoulder 116 disposed or formed at the first end 110 thereof. Each of the first end 110 and the second end 112 includes an aperture 118 formed therein to provide access to the cavity 114. As a non-limiting example, an exterior surface 120 extends between the first end 110 of the mandrel 102 and the second end 112 of the mandrel 102 and includes a tool detail 122 formed thereon such as a rib, a protrusion, a channel, and an annular array of splines, for example. It is understood that the tool detail 122 can have any shape, size, and contour. It is further understood that any number of the tool details 122 can be used.

The pilot 104 is moveably disposed in the cavity 114 formed in the mandrel 102. A first end 124 (i.e. stem) of the pilot 104 extends through the aperture 118 formed in the first end 110 of the mandrel 102. The first end 124 of the pilot 104 is configured to be inserted into an aperture of a blank 126 prepared from a desired material (shown in FIGS. 7-8). Any conventional material may be used to form the blank 126 such as steel, a steel alloy, or aluminum, for example. Similar to the blank 32 shown in FIG. 4, the blank 126 used in the present invention may be an annular ring or may have any shape such as round, for example, as desired.

In the embodiment shown, the pilot 104 is generally cylindrical and includes a portion 128 having a generally cylindrical, ring-like shape disposed between the first end 124 and a second end 130 thereof. A diameter of the portion 128 is typically greater than a diameter of at least one of the first end 124 of the pilot 104 and the second end 130 of the pilot 104. However, it is understood that the portion 128 can have any shape, size, and diameter. A camming surface 132 of the portion 128 is beveled at a pre-determined angle relative to an outer wall 134 of the portion 128. As a non-limiting example, the beveled camming surface 132 extends about the entire circumference of the portion 128. As a further non-limiting example, any part of the portion 128 can include a bevel or angled portion(s) configured to engage each of the inserts 108.

The ejector 106 is coupled to the second end 130 of the pilot 104. The ejector 106 controls a movement of the pilot 104 relative to the mandrel 102. As a non-limiting example, a plurality of threaded fasteners 135 can be used to coupled the ejector 106 to the pilot 104. However, other means of coupling the ejector 106 to the pilot 104 can be used. It is further understood that a movement of the pilot 104 within the mandrel 102 can be controlled by other means such as a spring (not shown) disposed in contact with the pilot 104 to impart motion thereto.

Each of the inserts 108 is moveably disposed in one of a plurality of radially outwardly extending channels 136 formed in the mandrel 102 and through the exterior surface 120 of the mandrel 102. It is understood that any number of the inserts 108 can be provided. Each of the inserts 108 includes a first end 137 disposed adjacent the pilot 104 and a second end 138 disposed opposite the first end 137. As a non-limiting example, the second end 138 of each of the inserts 108 includes at least one of a curved or angled contour. As a further non-limiting example, the second end 138 of each of the inserts 108 includes a plateau-like contour having a pair of angled surfaces (i.e. entry angle surface and exit angle surface) and a planar surface interposed between each of the angled surfaces, the planar surface generally parallel to the exterior surface 120 of the mandrel 102. However, the second end 138 of each of the inserts 108 can have any contour and shape.

In certain embodiments, a retaining element 140 is disposed in the cavity 114 formed in the mandrel 102. Specifically, the retaining element 140 is disposed adjacent each of the inserts 108 to limit a radial movement of the inserts 108 relative to the mandrel 102. As a non-limiting example, the retaining element 140 has an annular shape with an outside diameter less than an inside diameter of the cavity 114 formed in the mandrel 102. As a further non-limiting example, each of the inserts 108 includes a notched portion 141 and at least a portion (e.g. a reciprocal notch formed in the retaining element 140) of the retaining element 140 is disposed adjacent the notched portion 141 of each of the inserts 141 to limit a radial movement of the inserts 141 relative to the mandrel 102. It is understood that a length of the notched portion 141 of each of the inserts 108 can define a range of radial movement of the inserts 108 relative to the mandrel 102.

In certain embodiments, a locking element 142 is disposed in the cavity 114 formed in the mandrel 102 to abut the retaining element 140. As a non-limiting example, the locking element 142 is secured to the mandrel 102 (e.g. disposed in a groove or channel formed in the mandrel 102). The locking element 142 is spaced from the inserts 108 by a pre-determined distance and maintains a position of the retaining element 140 relative to the mandrel 102 and the inserts 108.

The process to form a part using the tool 100 is a multi-step process. First, the blank 126 is formed by punching, cutting, or shearing the blank 126 from a sheet stock of material to a predetermined shape. The blank 126 is then disposed in a flow forming apparatus (not shown) similar to the apparatus 40 illustrated in FIG. 4 and including the tool 100, a plurality of rollers (not shown), and a pressure plate (not shown). Specifically, the blank 126 is disposed on the first end 124 of the pilot 104 with the first end 124 of the pilot 104 extending through the aperture of the blank 126. The first end 124 of the pilot 104 and the pressure plate of the flow forming apparatus are positioned such that the first end 124 of the pilot 104 is received by a cavity formed in the pressure plate, as understood by one skilled in the art. The tool 100 and pressure plate are then clamped together with the blank 126 disposed therebetween.

Figure 8:
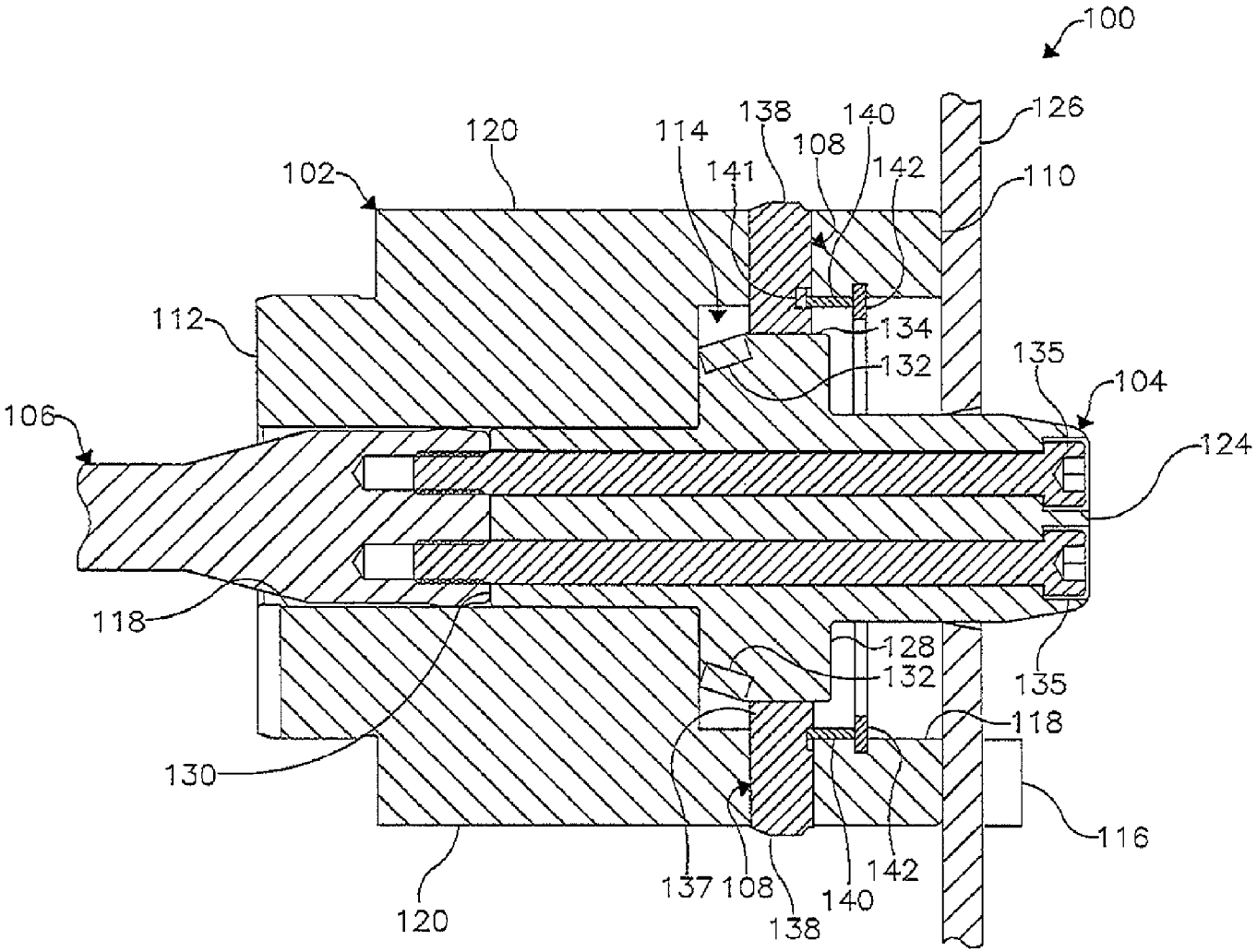
FIG. 8 is a fragmentary cross-sectional side elevational view of the tool of FIG. 5 with the pilot shown in a retracted position.
Figure 9:
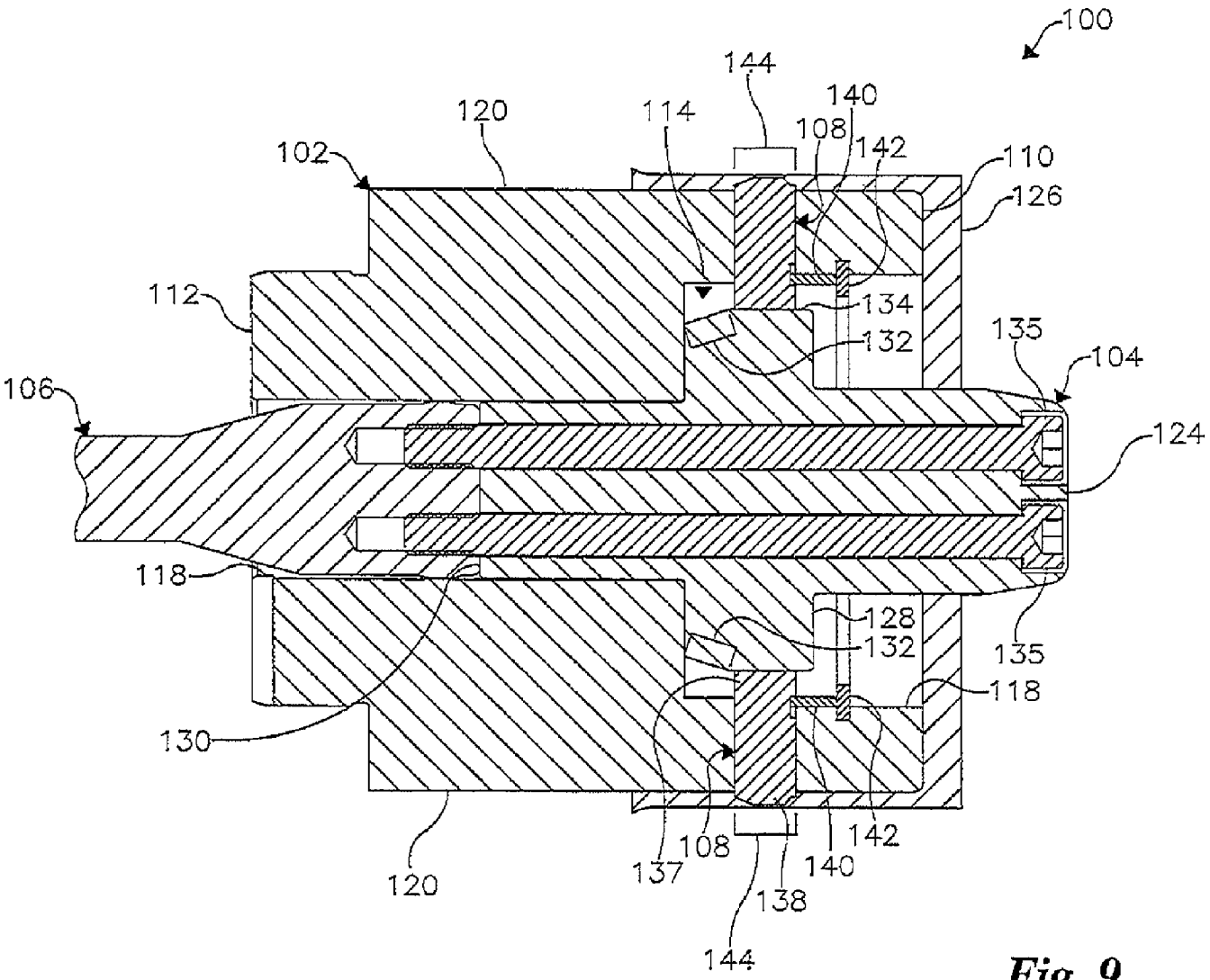
FIG. 9 is a fragmentary cross-sectional side elevational view of the tool of FIG. 5 including a final part formed from the blank.
Figure 10:
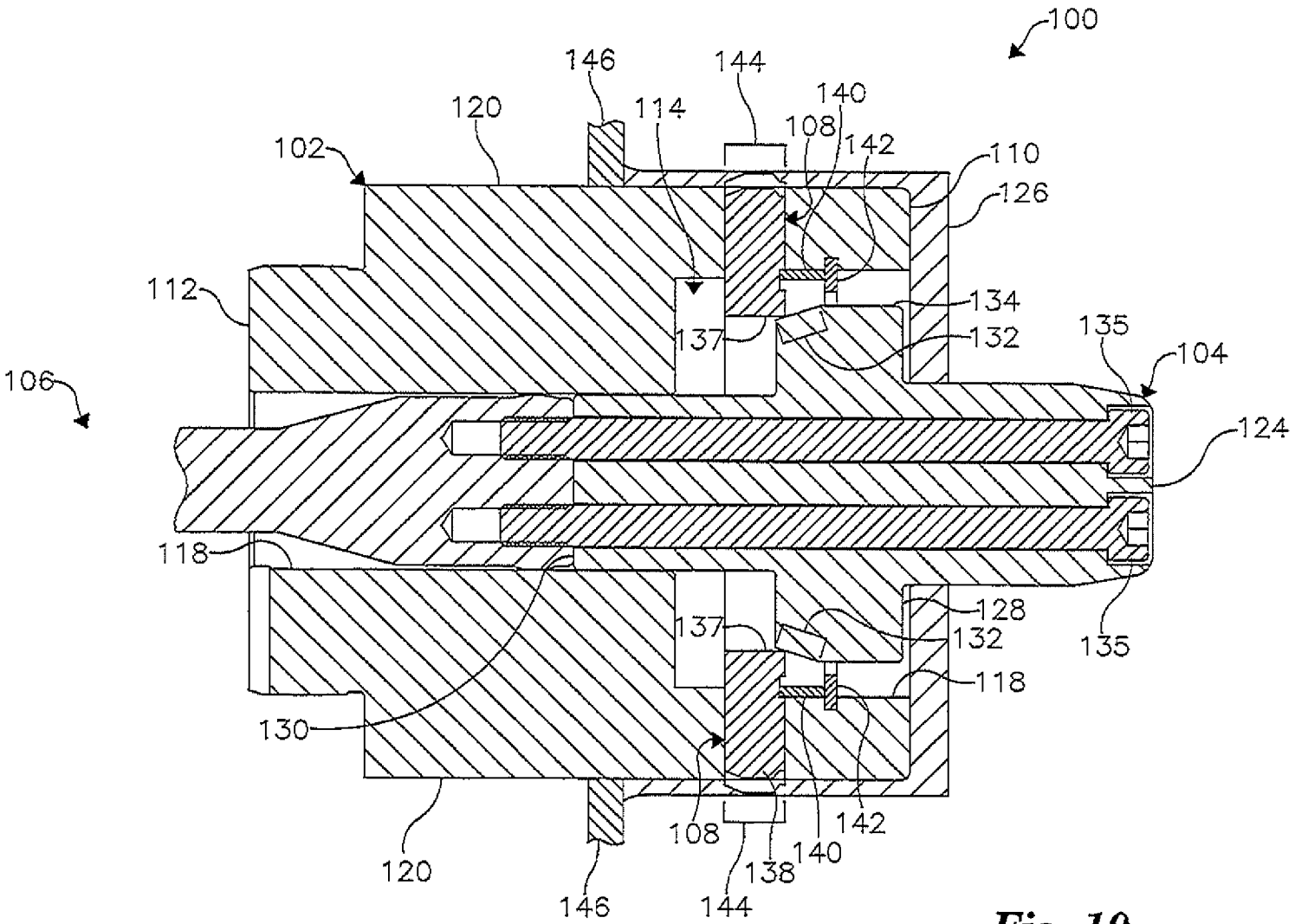
FIG. 10 is a fragmentary cross-sectional side elevational view of the tool of FIG. 9 disposed adjacent a stripper plate to remove the final part formed from the blank.

In the embodiment shown, the ejector 106 and the pilot 104 are retracted in an axial direction away from the blank 126. As the pilot 104 moves within the cavity of the mandrel 102, the caroming surface 132 of the pilot 104 applies a force to each of the inserts 108 to cause the inserts 108 to move in a radially outward direction relative to the mandrel 102. It is understood that the beveled contour of the camming surface 132 of the pilot 104 generates a force component in the radially outward direction on the first end 137 of the inserts 108 while the channels 136 formed in the mandrel 102 guide the inserts 108. As shown in FIG. 8, the pilot 104 is typically retracted until the outer wall 134 of the portion 128 is abutting each of the inserts 108, thereby securing the inserts 108 in an extended position, wherein the second end 138 of each of the inserts 108 protrudes from the exterior surface 120 of the mandrel 102. In certain embodiments, the clamping of the blank 126 on the tool 100 can force the pilot 104 to move axially away from the blank 126 to effect the same extension of the inserts 108 as described hereinabove.

The tool 100 and the blank 126 are then caused to rotate. Next, the rollers are caused to apply a pressure to the blank 126 to deform the blank 126 and cause the blank 126 to flow around the exterior surface 120 of the mandrel 102 (including the tool detail 122) and the second end 138 of each of the inserts 108. As the pressure on the blank 126 caused by the rollers increases, a temperature of the blank 126 increases and the blank 126 becomes malleable to facilitate the flow of the material that forms the blank 126 around the exterior surface 120 of the mandrel 102. It is understood that the contour of the second end 138 of each of the inserts 108 allows the malleable material of the blank 126 to be formed thereover.

Once the material of the blank 126 has been caused to form around the exterior surface 120 of the mandrel 102, the part formed from the blank 126 includes features 144 (e.g. indentations, oil holes, and the like) formed therein due to the contour/profile of the second end 138 of the inserts 108 and the tool detail 122 formed on the mandrel 102.

The ejector 106 and the pilot 104 are then extended toward the first end 110 of the mandrel 102. As the pilot 104 moves toward the first end 110 of the mandrel 102, the inserts 108 typically stay in the extended position and a gap is formed between the pilot 104 and each of the inserts 108. The part formed from the blank 126 is then removed from the mandrel 102 (e.g. by a stripper plate 144 know in the art). As the part formed from the blank 126 moves along the mandrel 102 toward the first end 110 of the mandrel 102, the part formed from the blank 126 applies a force to the second end 138 of each of the inserts 108 to cause the inserts 108 to move radially inwardly relative to the mandrel 102. It is understood that the contour/profile of the second end 138 of each of the inserts 108 can be configured to engage the part formed from the blank 126 to generate a force component in a radially inward direction relative to the mandrel 102 as the part is removed from the mandrel 102. Once the part formed from the blank 126 is completely removed from the mandrel 102, the features 144 (e.g. indentations, oil holes, and the like) formed in the part can be machined to remove excess material on an outside of the part (e.g. to create a smooth through-hole).

The tool 100 of the present invention allows forming of features such as oil holes through the use of moving tool details (i.e. the inserts 108). The contour/profile of the inserts 108 can be configured to create the features 144 having any shape, size, and location. The tool 100 including the moveable inserts 108 can be applied to the blank 126 to create a single or multiple rows of features such as oil holes.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An apparatus comprising:

a mandrel having a first end and a second end, the mandrel including a cavity formed therein;

a pilot disposed in the cavity Banned in the mandrel, a portion of the pilot extending outwardly from the first end of the mandrel;

an insert disposed in a channel formed in the mandrel and through an exterior surface of the mandrel, wherein a portion of the pilot abuts the insert and radial outward movement of the insert is caused by an axial movement of the pilot; and a retaining member disposed in the cavity formed in the mandrel, the retaining member disposed adjacent the insert to limit a radial movement of the insert relative to the mandrel.

2. The apparatus according to claim 1, wherein the exterior surface of the mandrel includes a tool detail formed thereon.

3. The apparatus according to claim 1, wherein the pilot includes a beveled camming surface enclosed by the mandrel and configured to slideably abut the insert to cause the insert to move radially outwardly with respect to the mandrel.

4. The apparatus according to claim 1, wherein the insert includes a first end disposed adjacent the pilot and a second end opposite the first end, the second end having at least one of a curved and an angled contour.

5. The apparatus according to claim 1, wherein the channel extends generally radially outwardly from the cavity formed in the mandrel.

6. The apparatus according to claim 1, wherein the retaining member is disposed adjacent a notched portion of the insert to limit a radial movement of the insert relative to the mandrel.

7. The apparatus according to claim 1, further comprising a locking element disposed in the cavity, the locking element abutting the retaining member and maintaining a position of the retaining element relative to the mandrel and the insert.

8. An apparatus comprising:

a mandrel having a first end and a second end, the mandrel having a cavity formed therein;

a pilot disposed in the cavity formed in the mandrel, a portion of the pilot extending outwardly from the first end of the mandrel;

an ejector coupled to a second end of the pilot opposite the first end of the pilot, wherein the ejector controls a movement of the pilot relative to the mandrel; and an insert moveably disposed in a channel formed in the mandrel and through an exterior surface of the mandrel, wherein a portion of the pilot abuts the insert and radially outward movement of the insert is caused by an axial movement of the pilot; and a retaining member disposed in the cavity formed in the mandrel, the retaining member disposed adjacent the insert to limit a radial movement of the insert relative to the mandrel.

9. The apparatus according to claim 8, wherein the exterior surface of the mandrel includes a tool detail formed thereon.

10. The apparatus according to claim 8, wherein the pilot includes a beveled camming surface enclosed by the mandrel and configured to slideably abut the insert to cause the insert to move radially outwardly with respect to the mandrel.

11. The apparatus according to claim 8, wherein the insert includes a first end disposed adjacent the pilot and a second end opposite the first end, the second end having at least one of a curved and an angled contour.

12. The apparatus according to claim 8, wherein the channel formed in the mandrel extends generally radially outwardly from the cavity formed in the mandrel.

13. The apparatus according to claim 8, wherein the retaining member is disposed adjacent a notched portion of the insert to limit a radial movement of the insert relative to the mandrel.

14. The apparatus according to claim 8, further comprising a locking element disposed in the cavity, the locking element abutting the retaining member and maintaining a position of the retaining element relative to the mandrel and the insert.

15. A method of forming a part, the method comprising the steps of:

providing a blank formed of a flowable material;

providing a tool including a mandrel having a first end and a second end, a pilot moveably disposed in a cavity formed in the mandrel, a portion of the pilot extending outwardly from the first end of the mandrel, and an insert moveably disposed in a channel formed through an exterior surface of the mandrel;

positioning the blank adjacent the first end of the mandrel; and applying pressure to the blank to cause the material of the blank to flow around the mandrel to form a part, at least a portion of the material flowing over the insert extending generally radially outwardly from the exterior surface of the mandrel.

16. The method according to claim 15, wherein the exterior surface of the mandrel includes a tool detail formed thereon.

17. The method according to claim 15, wherein the pilot includes a beveled camming surface enclosed by the mandrel and configured to slideably abut the insert to cause the insert to move radially outwardly with respect to the mandrel.

18. The method according to claim 15, wherein the insert includes a first end disposed adjacent the pilot and a second end opposite the first end, the second end having at least one of a curved and an angled contour.

19. The method according to claim 18, wherein the contour of the second end of the insert is configured to create a pre-determined feature in the part.

20. The method according to claim 15, wherein tool includes a retaining member disposed in the cavity formed in the mandrel, the retaining member disposed adjacent the insert to limit a radial movement of the insert relative to the mandrel.

* * * * *